US011638952B2

(12) United States Patent
Song et al.

(10) Patent No.: US 11,638,952 B2
(45) Date of Patent: May 2, 2023

(54) STEELMAKING-AND-CONTINUOUS-CASTING DISPATCHING METHOD AND APPARATUS BASED ON DISTRIBUTED ROBUST CHANCE-CONSTRAINT MODEL

(71) Applicant: Tsinghua University, Beijing (CN)

(72) Inventors: Shiji Song, Beijing (CN); Shengsheng Niu, Beijing (CN); Yali Chen, Beijing (CN)

(73) Assignee: TSINGHUA UNIVERSITY, Beijing (CN)

( * ) Notice: Subject to any disclaimer, the term of this patent is extended or adjusted under 35 U.S.C. 154(b) by 0 days.

(21) Appl. No.: 17/708,000

(22) Filed: Mar. 30, 2022

(65) Prior Publication Data

US 2022/0324014 A1 Oct. 13, 2022

(30) Foreign Application Priority Data

Mar. 31, 2021 (CN) ..... 202110351998.X

(51) Int. Cl.
*B22D 11/16* (2006.01)
*B22D 11/18* (2006.01)

(52) U.S. Cl.
CPC ..... *B22D 11/161* (2013.01); *B22D 11/18* (2013.01)

(58) Field of Classification Search
CPC ..... B22D 11/16; B22D 11/161; B22D 11/18
(Continued)

(56) References Cited

U.S. PATENT DOCUMENTS

2003/0122290 A1 7/2003 Wunsche
2008/0000327 A1 1/2008 Whitten et al.

FOREIGN PATENT DOCUMENTS

CN 101520656 A 9/2009
CN 101908092 A 12/2010
(Continued)

OTHER PUBLICATIONS

Shengsheng Niu, et al., A Distributionally Robust Chance Constrained Model to Hedge Against Uncertainty in Steelmaking-continuous Casting Production Process, Proceedings of the 2018 IEEE IEEM, 2018, pp. 411-416.

*Primary Examiner* — Kevin P Kerns
(74) *Attorney, Agent, or Firm* — Bayramoglu Law Offices LLC

(57) ABSTRACT

A steelmaking-and-continuous-casting dispatching method and apparatus based on a distributed robust chance-constraint model. The method includes: according to parameters, an objective function and a constraint condition in steelmaking-and-continuous-casting dispatching, establishing the distributed robust chance-constraint model; by using a dual-approximation method or a linear-programming-approximation method, solving the distributed robust chance-constraint model, to obtain processing starting durations of cast batches in conticasters and processing starting durations of furnace batches in machines other than the conticasters; and by using a solved result of the distributed robust chance-constraint model as an evaluation criterion, by using a tabu-search algorithm, determining a furnace-batch sequence and a distribution theme in the steelmaking-and-continuous-casting dispatching. The method deems the processing duration in the steelmaking-and-continuous-casting process as a random variable, and makes the description by using the polyhedral support set and the accurate moment information, and the method meets the actual production conditions more than the conventional research models.

8 Claims, 5 Drawing Sheets

(58) Field of Classification Search
USPC ..... 164/452, 449.1, 154.5
See application file for complete search history.

(56) References Cited

FOREIGN PATENT DOCUMENTS

| | | | |
|---|---|---|---|
| CN | 103996146 | A | 8/2014 |
| CN | 105550751 | A | 5/2016 |
| CN | 106779486 | A | 5/2017 |
| CN | 108303958 | A | 7/2018 |
| CN | 110064741 | A | 7/2019 |

STEELMAKING-AND-CONTINUOUS-CASTING DISPATCHING METHOD AND APPARATUS BASED ON DISTRIBUTED ROBUST CHANCE-CONSTRAINT MODEL

CROSS REFERENCE TO THE RELATED APPLICATIONS

This application is based upon and claims priority to Chinese Patent Application No. 202110351998.X, filed on Mar. 31, 2021, the entire contents of which are incorporated herein by reference.

TECHNICAL FIELD

The present disclosure relates to the technical field of optimization of production dispatching and production-related resources, and particularly relates to a steelmaking-and-continuous-casting dispatching method and apparatus based on a distributed robust chance-constraint model.

BACKGROUND

The steelmaking industry plays a key role in many important manufacturing industries, such as the car and ship building industries. Generally, the entire production process of the steel industry comprises three main stages, namely ironmaking, steelmaking and continuous casting, and hot rolling, wherein the process of steelmaking and continuous casting is the critical and bottleneck process connecting the upstream and downstream processes, and involves the most complicated process flow. Therefore, an effective steelmaking-and-continuous-casting dispatching method is of vital importance for increasing the production efficiency and reducing the production cost.

The production process of steelmaking and continuous casting, as shown in FIG. 1, generally comprises three main stages, namely steelmaking, refinement, and continuous casting. In the stage of steelmaking, the liquid iron is delivered to a workshop provided with preliminary-refinement furnaces such as an electric-arc furnace, an open-hearth furnace, and a converting furnace, and combusted with the oxygen within the furnaces, to reduce the impurities such as carbon and silicon to an ideal level. The liquid iron that is treated in the same one preliminary-refinement furnace is referred to as a furnace batch, which is the basic unit of the steelmaking-and-continuous-casting process. After the furnace batch has been completely treated in the preliminary-refinement furnace, it is delivered to a refining furnace. In this stage, the furnace batch is required to be specially treated to further refine the chemical substances, remove the impurities, or add the required alloy elements, and devices such as a ladle furnace and a refining furnace are used for different modes of the refinement. The liquid steel obtained after the refinement is delivered to a conticaster to be cast into slabs. In this stage, the furnace batch is delivered to the casting site, and the liquid steel is poured into a tundish, passes through a crystallizer, cools, and then solidifies into the slabs. The furnace batches that have the similar chemical composition and are continuously cast in the same one conticaster are referred to as a cast batch. Regarding the issue of steelmaking-and-continuous-casting dispatching, because one tundish is shared, the furnace batches of the same one cast batch are required to be continuously cast, without any downtime. In the event of casting interruption, the tundish cannot be used any more, whereby the tundish is required to be replaced, which results in a huge fixed cost and an additional starting-up duration. Moreover, the remaining furnace batches are required to be reheated, which also causes a lot of additional time and energy cost. The reduction of casting interruption can effectively reduce the production cost, so casting-interruption downtime has always been considered as one of the most important targets in the issue of steelmaking-and-continuous-casting dispatching. Other production targets are also taken into consideration, such as the waiting duration, the machine efficiency, the total flow duration and the total delay duration.

In the past few decades, many steel enterprises and researchers have extensively studied the issue of steelmaking-and-continuous-casting dispatching, and operational research and intelligent search are two mainly employed methods for solving the problem of steelmaking-and-continuous-casting dispatching. In the method of operational research, usually a mathematical model is established, to obtain the optimal solution or the quasi-optimal solution by using an accurate or heuristic algorithm. The target of the method of intelligent search is to find the quasi-optimal solution in a relatively short computing time. The mostly commonly used methods of dispatching intelligent search use algorithms that include tabu-searching, ant colony optimization, particle swarm optimization, artificial bee colony, differential evolution, cuckoo search, and scatter searching. Moreover, that may also be based on an expert system and a fuzzy algorithm.

Accidental events in the steelmaking-and-continuous-casting process may be classified into two types according to the degree of the affection on the current plan. One type is critical events, such as long-term machine faults, furnace batch reworking and furnace batch canceling. The other type is non-critical events, such as small fluctuations of the treatment time and short-term machine faults. When the critical events happen, it is inevitable to change the original plan. However, for non-critical events, it is not necessary to reformulate the entire dispatching plan. In practical production process, the frequency of the non-critical events is usually much higher than that of the critical events, so re-dispatching is not the best solution of handling the everyday small disturbances. Currently, the most common solution is to postpone the original plan to delay the furnace batch or delay the arrival of the transportation. In practical production process, such a task is usually completed artificially, and the performance of the obtained plan depends on the experience of the dispatcher. Moreover, such an approach usually cannot obtain the optimal solution, which results in the increase of the objective functions. Therefore, a robust timetable that is immune to the small fluctuations in the everyday production is required.

Currently, there have already been some studies on the issue of steelmaking-and-continuous-casting dispatching in an indefinite environment, among which an important method is robustness optimization. The method assumes that the indefinite parameters are within a certain interval, and the target is to find a dispatching theme that is feasible to all of the possible values of the indefinite parameters. Another commonly used method is stochastic programming. The method assumes that the indefinite parameters follow a certain distribution, and optimizes the objective functions in a desired sense. Besides the above two methods, the method based on soft decision and the fuzzy algorithm may also be used to solve the problem of steelmaking-and-continuous-casting dispatching in an indefinite environment. However, the method of robustness optimization merely takes into consideration the support set but ignores the moment information, and the obtained dispatching theme is too conservative, and cannot be applied to practical applications. Regarding the method of stochastic programming, the accurate distribution of the indefinite parameters is usually very difficult to acquire, especially for a new production line or a new machine. Even if the distribution in the predefined distribution set may be estimated according to the historical-data fitting, if the preselected distribution set is inadequate, the solution might still be unstable. Therefore, it is necessary to handle the problem of casting interruption in the steelmaking-and-continuous-casting process by using a distributed robust model.

Scarf et al firstly proposed the method of distributed robustness optimization, to solve the problem of inventory. The method assumes that the indefinite parameters belong to a certain distribution set, and the target is to acquire the decision making on the optimum performance in the worst case. The distribution set may be defined by using different methods, and the mostly used method is based on the distribution set of the moments, i.e., by using description on the average value, the covariance and the supporting information. Moreover, the distribution set may be described by using other methods, for example, a unimodal distribution set, a distribution set based on the Wasserstein metry with the uniform distribution of the training samples as the center, and so on. When the uncertainty is in the objective function, the method of distributed robustness optimization seeks a solution that has an excellent behavior for all of the possible distributions in the distribution set. When the uncertainty is expressed by constraint, the distributed robust chance-constraint model ensures that the constraint has the pre-specified probability for all of the possible distributions.

SUMMARY

The present disclosure aims at solving at least one of the technical problems in the relevant art to a certain extent.

Accordingly, an object of the present disclosure is to provide a steelmaking-and-continuous-casting dispatching method based on a distributed robust chance-constraint model. The method provides a high-efficiency and low-cost solution of steelmaking-and-continuous-casting dispatching.

Another object of the present disclosure is to provide a steelmaking-and-continuous-casting dispatching apparatus based on a distributed robust chance-constraint model.

In order to achieve the above objects, an embodiment of an aspect of the present disclosure provides a steelmaking-and-continuous-casting dispatching method based on a distributed robust chance-constraint model, wherein the method comprises:

according to parameters, an objective function and a constraint condition in steelmaking-and-continuous-casting dispatching, establishing the distributed robust chance-constraint model;

by using a dual-approximation method or a linear-programming-approximation method, solving the distributed robust chance-constraint model, to obtain processing starting durations of cast batches in conticasters and processing starting durations of furnace batches in machines other than the conticasters; and by using a value of the objective function obtained by solving the distributed robust chance-constraint model as an evaluation index, by using a tabu-search algorithm, determining a furnace-batch sequence and a distribution theme in the steelmaking-and-continuous-casting dispatching.

In order to achieve the above objects, an embodiment of another aspect of the present disclosure provides a steelmaking-and-continuous-casting dispatching apparatus based on a distributed robust chance-constraint model, wherein the apparatus comprises:

an establishing module configured for, according to parameters, an objective function and a constraint condition in steelmaking-and-continuous-casting dispatching, establishing the distributed robust chance-constraint model;

a solving module configured for, by using a dual-approximation method or a linear-programming-approximation method, solving the distributed robust chance-constraint model, to obtain processing starting durations of cast batches in conticasters and processing starting durations of furnace batches in machines other than the conticasters; and a dispatching module configured for, by using a value of the objective function obtained by solving the distributed robust chance-constraint model as an evaluation index, by using a tabu-search algorithm, determining a furnace-batch sequence and a distribution theme in the steelmaking-and-continuous-casting dispatching.

The steelmaking-and-continuous-casting dispatching method and apparatus based on a distributed robust chance-constraint model according to the embodiments of the present disclosure have the following advantages:

1) The processing duration of the furnace batch is deemed as a random variable within a certain distribution set. The commonly used model of steelmaking and continuous casting is modified, to be more reasonable, and the distributed robust chance-constraint model is proposed to determine the timetable in the steelmaking-and-continuous-casting process.

2) In the distribution set of the distributed robust chance-constraint model, the support set in the form of a polyhedron and the accurate moment information are taken into consideration at the same time for the first time, and a dual approximation method and a linear-programming approximation method are proposed.

3) A distributed robust chance-constraint model combined with the tabu-search algorithm is proposed to solve the problem of casting interruption in the steelmaking-and-continuous-casting process.

Some of the additional aspects and advantages of the present disclosure will be given in the following description, and some will become apparent from the following description or be known from the implementation of the present disclosure.

BRIEF DESCRIPTION OF THE DRAWINGS

The above and/or additional aspects and advantages of the present disclosure will become apparent and readily understandable from the following description on the embodiments with reference to the drawings. In the drawings.

DETAILED DESCRIPTION OF THE EMBODIMENTS

Figure 1:
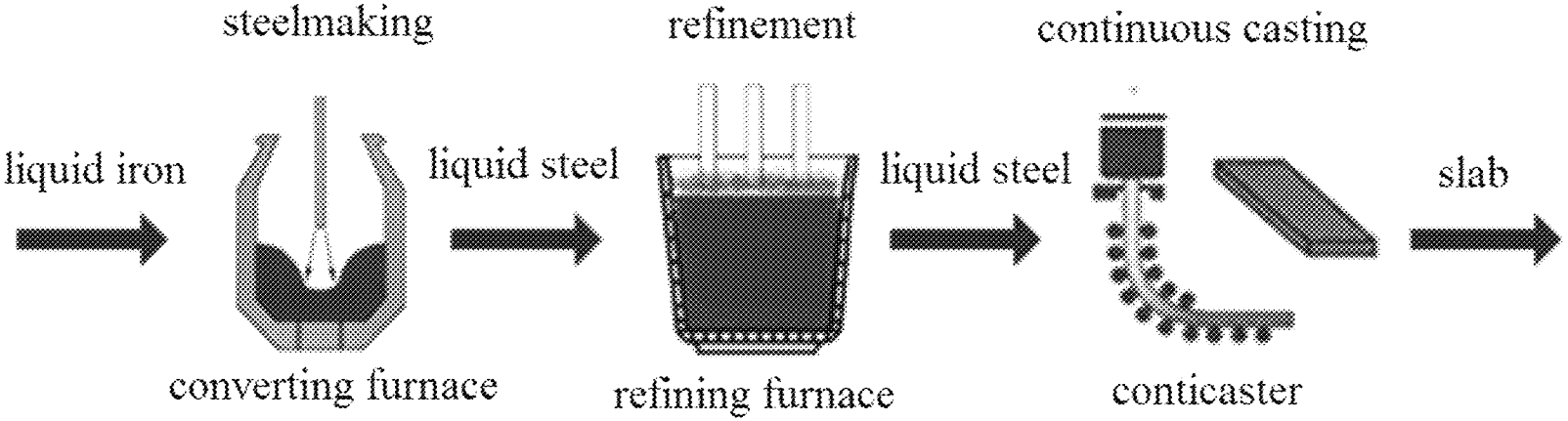
FIG. 1 is a schematic diagram of the production process of the dispatched steelmaking and continuous casting according to an embodiment of the present disclosure.

The embodiments of the present disclosure will be described in detail below, and the examples of the embodiments are illustrated in the drawings, wherein the same or similar reference numbers throughout the drawings indicate the same or similar elements or elements having the same or similar functions. The embodiments described below with reference to the drawings are exemplary, are intended to interpret the present disclosure, and should not be construed as a limitation on the present disclosure.

The steelmaking-and-continuous-casting dispatching method and apparatus based on a distributed robust chance-constraint model according to the embodiments of the present disclosure will be described below with reference to the drawings.

The steelmaking-and-continuous-casting dispatching method based on a distributed robust chance-constraint model according to the embodiments of the present disclosure will be described with reference to the drawings firstly.

Figure 2:
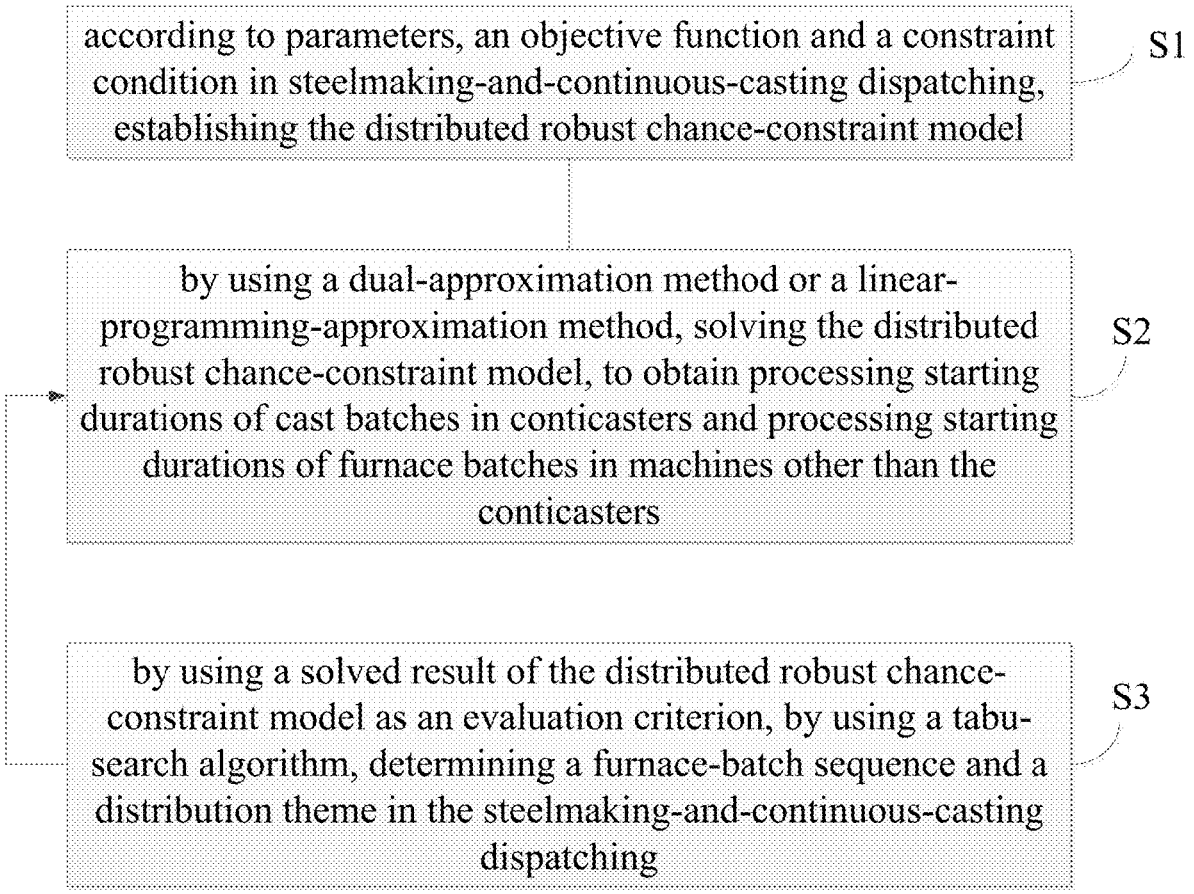
FIG. 2 is a flow chart of the steelmaking-and-continuous-casting dispatching method based on a distributed robust chance-constraint model according to an embodiment of the present disclosure.

FIG. 2 is a flow chart of the steelmaking-and-continuous-casting dispatching method based on a distributed robust chance-constraint model according to an embodiment of the present disclosure.

As shown in FIG. 2, the steelmaking-and-continuous-casting dispatching method based on a distributed robust chance-constraint model comprises the following steps:

Step S1: according to parameters, an objective function and a constraint condition in steelmaking-and-continuous-casting dispatching, establishing the distributed robust chance-constraint model.

Particularly, 1-1) establishing a distributed robust chance-constraint model 1-1-1) determining the indefinite parameters of the model.

It is assumed that the indefinite processing duration is the random vector $\tilde{p}$, and its exact distribution is expressed as F, which is not known but belongs to the distribution set $D_1$. The distribution set is shown in the formula (1), and is described by using the support set, the average value and the covariance:

$$D_1=\{F|P(\tilde{p}\in\Omega)=1,\ E_F[\tilde{p}]=\mu_0,\ E_F[(\tilde{p}-\mu_0)(\tilde{p}-\mu_0)^T]=\Sigma_0\} \tag{1}$$

wherein $\Omega$ is the support set of the indefinite processing duration $\tilde{p}$, and may be a polyhedron, a spheroid or a more general form of quafric curves in the distribution set. In the practical production process, the most convenient and most commonly seen form is shown in the formula (2):

$$\underline{p}\le\tilde{p}\le\overline{p} \tag{2}$$

wherein $\underline{p}$ is the lower limit of the processing duration, and $\overline{p}$ is the upper of the processing duration.

1-1-2) determining the parameters and the decision variables of the model.

According to the practical production situations and the requirements of the model, it is designed that the parameter N represents a set of all of the furnace batches, K represents a set of all of the cast batches, $M_i$ represents a set of machines of a processing furnace batch i including the conticasters, C represents a set of the conticasters, $C_k$ represents conticasters of a processing cast batch k, $\Phi_k$ represents a furnace-batch set corresponding to the cast batches k, $s^i_j$ represents a subsequent furnace batch processed in a machine j immediately following the furnace batch i, $t_{j1,j2}$ represents a transportation duration from a machine $j_1$ to a machine $j_2$, $ms^i_j$ represents a subsequent machine immediately following the processing furnace batch i of the machine j, $mp^i_j$ represents a preceding machine immediately preceding the processing furnace batch i of the machine j, $o_{ij}$ represents a sequence of the furnace-batches i in the processing cast batch in the machine j, $p_{ij}$ represents a processing duration of the furnace batch i in the machine j, st represents a starting-up duration between two cast batches, and $cs_k$ represents a subsequent cast batch immediately following a cast batch k in a same one conticaster.

It is designed that the decision variable $sx_k$ represents a processing starting duration of a first furnace batch of the cast batch k, and $x_{ij}$ represents a processing starting duration of the furnace batch i in the machine j other than the conticasters.

1-1-3) determining the objective function of the model.

Considering that the cost in the waiting duration will result in the cost in the cooling of the liquid steel, it is designed that the objective function is shown in the formula (3), and is formed by three parts, which are individually the cost in the waiting duration between the stages of refinement and continuous casting, the cost in the waiting duration between the stages of steelmaking and refinement, and the total flow duration. Because the processing duration is a random variable, the objective function is optimized in a desired sense. In the formula (3), $c_1$, $c_2$ and $c_3$ represent the penalty coefficients of the three items respectively.

$$\begin{aligned}\min\ & c_1\sum_{k\in K}\sum_{i\in\Phi_k}E\Big(\sum_{l\in\Phi_k,o_{l,C_k}<o_{i,C_k}}\tilde{p}_{l,C_k}+ sx_k-x_{i,mp^i_{C_k}}-\tilde{p}_{i,mp^i_{C_k}}-t_{mp^i_j,C_k}\Big)+\\ & c_2\sum_{i\in N}\sum_{j\in M_i,ms^i_j\notin C}E\Big(x_{i,ms^i_j}-x_{ij}-\tilde{p}_{ij}-t_{j,ms^i_j}\Big)+\\ & c_3\sum_{k\in K}\sum_{i\in\Phi_k}E\Big(\sum_{l\in\Phi_k,o_{l,C_k}<o_{i,C_k}}\tilde{p}_{l,C_k}+sx_k+\tilde{p}_{i,C_k}\Big)\end{aligned} \tag{3}$$

1-1-4) determining the constraint conditions of the model.

The constraint condition (4) is designed to ensure the continuity of the cast batches, wherein the right side of the inequality in the brackets represents the time when the furnace batch i arrives at the conticaster, and the left side represents the completion time of the immediately consecutive preceding furnace batch of the furnace batch i. Therefore, the constraint (4) represents that, in a conticaster, when a furnace batch has completed the processing, a furnace batch to be processed next immediately should already reach the conticaster for the processing.

$$\inf_{F\in D_1}P\Big(\sum_{l\in\Phi_k,o_{l,C_k}<o_{l,C_k}}\tilde{p}_{l,C_k}+sx_k\ge x_{i,mp^i_{C_k}}+\tilde{p}_{i,mp^i_{C_k}}+t_{mp^i_{C_k},C_k}\Big)\ge 1-\varepsilon,\ \forall\ k\in K,\ i\in\Phi_k \tag{4}$$

The constraint conditions (5) and (6) are designed to ensure the starting-up duration of the cast batches. The constraint (5) represents that a starting duration of each of the cast batches is at least greater than or equal to a starting-up duration of the cast batch. The constraint (6) represents that, in two immediately consecutive cast batches in a same one conticaster, a processing starting duration of the subsequent cast batch should be greater than or equal to a sum between a processing completing duration and a starting-up duration of the preceding cast batch.

$$sx_k \geq st, \forall k \in K \tag{5}$$

$$\inf_{F \in D_1} P\left(sx_{cs_k} \geq sx_k + \sum_{l \in \Phi_k} \tilde{p}_{l,C_k} + st\right) \geq 1 - \varepsilon, \forall k \in K \tag{6}$$

The constraint conditions (7), (8) and (9) are designed to ensure that the processing starting duration satisfies the process flow. The constraint (7) represents that a processing starting duration of any one of the cast batches is at least greater than or equal to a sum of a processing completing duration and a transportation duration of a first furnace batch in the cast batch at a preceding stage. The constraint (8) represents that, other than the conticasters, in two immediately consecutively processed furnace batches in a same one machine, merely after the preceding furnace batch has completed the processing, the subsequent furnace batch can be processed. The constraint (9) represents that, in two successive processing processes in any one of the furnace batches, merely after the preceding processing process has been completed and the furnace batch has been delivered to the subsequent machine, the subsequent processing process can be started.

$$\inf_{F \in D_1} P\left(sx_k \geq x_{i,mp^i_{C_k}} + \tilde{p}_{i,mp^i_{C_k}} + t_{mp^i_{C_k},C_k}\right) \geq 1 - \varepsilon, \quad \forall i \in \Phi_k,\ o_{i,C_k} = 1 \tag{7}$$

$$\inf_{F \in D_1} P\left(x_{s^i_j,j} - x_{ij} \geq \tilde{p}_{ij}\right) \geq 1 - \varepsilon, \forall i \in N,\ j \in M_i / C \tag{8}$$

$$\inf_{F \in D_1} P\left(x_{i,ms^i_j} - x_{ij} \geq \tilde{p}_{ij} + t_{j,ms^i_j}\right) \geq 1 - \varepsilon, \forall i \in N,\ ms^i_j,\ j \in M,\ ms^i_j \notin C) \tag{9}$$

Step S2: by using a dual-approximation method or a linear-programming-approximation method, solving the distributed robust chance-constraint model, to obtain processing starting durations of cast batches in conticasters and processing starting durations of furnace batches in machines other than the conticasters.

Optionally, the step of, by using the dual-approximation method or the linear-programming-approximation method, solving the distributed robust chance-constraint model comprises:

by using the dual-approximation method, converting the distributed robust chance-constraint model, to convert the distributed robust chance-constraint model into a positive-semidefinite planning problem; or by using the linear-programming-approximation method, performing accelerated solving to the distributed robust chance-constraint model, to convert the distributed robust chance-constraint problem into a linear-programming problem.

Particularly, in the distributed robust chance-constraint model, each of the constraints may be expressed as a general form, as shown in the formula (10), to convert the model by using the dual-approximation method and the linear-programming-approximation method individually.

$$\inf_{F \in D_1} P\left(a^T \tilde{p} + b^T x + c \leq 0\right) \geq 1 - \varepsilon \tag{10}$$

2-1) converting the model by using the dual-approximation method.

The general form (10) of the chance constraint is equivalent to the CVaR constraint in the worst case as shown in the formula (11), wherein the left side of inequality may also be expressed as shown in the formula (12), wherein $[x]^+ = \max\{0,x\}$.

$$\sup_{F \in D_1} F - CVaR_\varepsilon\left(a^T \tilde{p} + b^T x + c\right) \leq 0 \tag{11}$$

$$\begin{aligned} \sup_{F \in D_1} F - CVaR_\varepsilon\left(a^T \tilde{p} + b^T x + c\right) &= \\ \sup_{F \in D_1} \inf_{\beta \in R} \left\{\beta + \frac{1}{\epsilon} E_F\left(\left(a^T \tilde{p} - b^T x + c - \beta\right)^+\right)\right\} &= \\ \inf_{\beta \in R} \left\{\beta + \frac{1}{\epsilon} \sup_{F \in D_1} E_F\left(\left(a^T \tilde{p} + b^T x + c - \beta\right)^+\right)\right\} \end{aligned} \tag{12}$$

According to the theorem of strong dual, the formula (12) may be equivalently converted into an optimization problem, as shown in the formula (13) to the formula (16). Regarding the optimization problem, different support sets result in different solving methods and solution difficulties. When the support set $\Omega = R^d$, the constraint (14) and the constraint (15) may be rewritten into positive-semidefinite constraints, and solved by using a common solver. When the support set is a spheroid, i.e., $\Omega = \{\tilde{p} | (\tilde{p} - p_0)^T \Theta (\tilde{p} - p_0) \leq 1\}$, a linear matrix inequality may be used to approximate the positive-semidefinite constraints on $\Omega$.

$$\inf \beta + \frac{1}{\epsilon}\left(y_0 + u_0^T y + \left\langle \sum_0, Y \right\rangle\right) \tag{13}$$

$$\text{s.t. } y_0 - b^T x - c + \beta + \left(y^T - a^T\right)\tilde{p} + \left\langle Y, \tilde{p}\tilde{p}^T \right\rangle \geq 0, \forall \tilde{p} \in \Omega \tag{14}$$

$$y_0 + y^T \tilde{p} + \left\langle Y, \tilde{p}\tilde{p}^T \right\rangle \geq 0, \forall \tilde{p} \in \Omega \tag{15}$$

$$y_0 \in R,\ \beta \in R,\ y \in R^d,\ Y \in R^{d \times d} \tag{16}$$

wherein $\langle A, B \rangle = \sum A_{ij} B_{ij}$.

When the support set is a polyhedron, i.e., $\Omega = \{\tilde{p} | H\tilde{p} | \leq h\}$, the constraint (15) and the constraint (16) are unitary constraints; in other words, it is required that the two matrixes shown in the formula (17) are unitary matrixes on the support set $\Omega$. However, even to determine whether a given matrix is unitary is an NP complete problem. Therefore, when the support set of the indefinite parameters is a polyhedron, the solving of the converted optimization problem is still very difficult, and, for such a situation, a method of dual approximation is designed to perform model conversion again.

$$\begin{bmatrix} y_0 - b^T x - c + \beta & \frac{1}{2}(y - a) \\ \frac{1}{2}\left(y^T - a^T\right) & Y \end{bmatrix}, \begin{bmatrix} y_0 & \frac{1}{2} y \\ \frac{1}{2} y^T & Y \end{bmatrix} \tag{17}$$

For any $x \in R^d$, if there are $y_0$, v, $z \in R$, $y \in R^d$, $\tau$, $\eta \in R^1$, $Y \in R^{d \times d}$, U, $W \in R^{1 \times l}$, and $$V_0 = \begin{bmatrix} v & v^T \\ v & V \end{bmatrix}, Z_0 = \begin{bmatrix} z & z^T \\ z & Z \end{bmatrix} \in R^{(d+1)x(d+1)},$$

which satisfies the constraint conditions shown in the formula (18) to the formula (25), then x is also a feasible solution of the constraint condition (10); in other words, the constraint conditions (18) to (25) form the conservative approximation of the feasible set corresponding to the constraint condition (10).

$$\beta - \frac{1}{\epsilon}\left(y_0 + u_0^T y + \left\langle \sum_0, Y \right\rangle\right) \le 0 \tag{18}$$

$$y_0 - b^T x - c + \beta - \tau^T h - \langle U, hh^T \rangle - v \ge 0 \tag{19}$$

$$y_0 - \eta^T h - \langle W, hh^T \rangle - z \ge 0 \tag{20}$$

$$y - a + H^T \tau + 2H^T Uh - 2v = 0 \tag{21}$$

$$V_0 \ge 0,\ \tau \ge 0,\ U = U^T,\ U \ge 0 \tag{22}$$

$$y + H^T \eta + 2H^T Wh - 2z = 0 \tag{23}$$

$$Y - Z - H^T WH = 0,\ Y - V - H^T UH = 0 \tag{24}$$

$$Z_0 \ge 0,\ \eta \ge 0,\ W = W^T W \ge 0 \tag{25}$$

Therefore, when the support set of the processing duration $\tilde{p}$ is as shown in the formula (26), the distributed robust chance-constraint model may be conservatively converted into a dual-approximation model, as shown in the formula (27) to the formula (35), wherein i=1, . . . , J, wherein J is the quantity of the constraints of the distributed robust chance-constraint model.

$$\Omega = \{\tilde{p} \mid \underline{p} \le \tilde{p} \le \overline{p}\} \tag{26}$$

$$\min c_1 \tag{27}$$

$$\sum_{k\in K}\sum_{l\in\Phi_k} E\left(\sum_{l\in\Phi_k, o_{l,C_k} < o_{l,C_k}} \tilde{p}_{l,C_k} + sx_k - x_{i,mp^i_{C_k}} - \tilde{p}_{i,mp^i_{C_k}} - t_{mp^i_j, C_k}\right) + c_2 \sum_{i\in N}\sum_{j\in M_i, ms^i_j \notin C} E\left(x_{i,ms^i_j} - x_{ij} - \tilde{p}_{ij} - t_{j,ms^i_j}\right) + c_3 \sum_{k\in K}\sum_{l\in\Phi_k} E\left(\sum_{l\in\Phi_k, o_{l,C_k} < o_{l,C_k}} \tilde{p}_{l,C_k} + sx_k + \tilde{p}_{l,C_k}\right)$$

$$\text{s.t } \beta^i + \frac{1}{\epsilon}\left(y_0^i + u_0^T y^i + \left\langle \sum_0, Y^i \right\rangle\right) \le 0 \tag{28}$$

$$y_0^i - b^{iT} x - c^i + \beta^i + \tau_1^{iT} \underline{p} - \tau_2^{iT} \overline{p} - \langle U^i, \underline{pp}^T \rangle - v^i \ge 0 \tag{29}$$

$$y_0^i + \eta_1^{iT} \underline{p} - \eta_2^{iT} \overline{p} - \langle W^i, \underline{pp}^T \rangle - z^i \ge 0 \tag{30}$$

$$y^i - a^i - \tau_1^i + \tau_2^i + 2U^i \underline{p} - 2v^i = 0 \tag{31}$$

$$V_0^i \ge 0,\ \tau_1^i, \tau_2^i \ge 0,\ U^i = U^{iT},\ U^i \ge 0 \tag{32}$$

$$y^i - \eta_1^i + \eta_2^i + 2W^i \underline{p} - 2z^i = 0 \tag{33}$$

$$Y^i - Z^i - W^i = 0,\ Y^i - V^i - U^i = 0 \tag{34}$$

$$Z_0^i \ge 0,\ \eta_1^i, \eta_2^i \ge 0,\ W^i = W^{iT},\ W^i \ge 0 \tag{35}$$

It can be seen that the dual-approximation model provides an upper bound for the original problem. Considering the distribution set $D_2$ shown in the formula (36), it is usually used for the case of indefinite covariance matrix estimation, and when $\gamma=1$, it may be deemed as the relaxation of the distribution set $D_1$, and can obtain more robust but more conservative solutions. It can be proved that the upper bound obtained by the dual-approximation model is at least as good as the optimum target value obtained by the distributed robust chance-constraint model whose distribution set is $D_2$.

$$D_2 = \{F \mid P(\tilde{p} \in \Omega) = 1,\quad E_F[\tilde{p}] = \mu_0,\quad E_F[(\tilde{p} - \mu_0)(\tilde{p} - \mu_0)^T] \le \gamma\Sigma_0\} \tag{36}$$

2-2) converting the model by using the linear-programming-approximation method.

Although the dual-approximation model has conservatively converted the distributed robust chance-constraint model into a positive-semidefinite planning problem, especially when the problem has a very large scale, the solving of such a problem might still be very time consuming. Therefore, an accelerated approximation method is provided for the sub-problem whose support set is shown in the formula (26), to approximately convert the distributed robust chance-constraint problem into a linear-programming problem, whereby the large-scale problem can be better handled.

Considering the random variable $\xi = a^T\tilde{p}$, it distribution set is shown in the formula (37), and, accordingly, the feasible set corresponding to the constraint condition shown in the formula (38) may form a conservative approximation of the feasible set corresponding to the chance constraint whose general form is shown in the formula (10), wherein $t_0$ is the minimum value that satisfies $h'(t_0) \ge 1-\epsilon$, and the definition of $h'(t_0)$ is shown in the formulas (39) and (40).

$$D_\xi = \left\{F \,\middle|\, P(\xi \in [a^T\underline{p}, a^T\overline{p}]) = 1,\ E_F[\xi] = a^T\mu_0,\ \mathrm{Var}(\xi) = a^T\sum_0 a\right\} \tag{37}$$

$$t_0 + b^T x + c \le 0 \tag{38}$$

$$h'(t_0) = \begin{cases} 0, & t_0 < \alpha_1 \\ \dfrac{(t_0 a^T\mu_0)(a^T\overline{p} - a^T\mu_0) + a^T\sum_0 a}{(t_0 - a^T\underline{p})(a^T\overline{p} - a^T\underline{p})}, & \alpha_1 \le t_0 < \alpha_2 \\ \dfrac{(t_0 - a^T\mu_0)^2}{(t_0 - a^T\mu_0)^2 + a^T\sum_0 a}, & \alpha_2 \le t_0 < a^T\overline{p} \\ 1, & t_0 \ge a^T\overline{p} \end{cases} \tag{39}$$

$$\alpha_1 = a^T\mu_0 - \frac{a^T\sum_0 a}{a^T\overline{p} - a^T\mu_0},\ \alpha_2 = a^T\mu_0 + \frac{a^T\sum_0 a}{a^T\mu_0 - a^T\underline{p}} \tag{40}$$

Because when $\Sigma_0 > 0$, $D_1 \subseteq D_\xi \subseteq D_4$, wherein the definition of $D_4$ is shown in the formulas (41) to (43), $\lambda_{min}$ the minimum characteristic value of $\Sigma_0$, it can be seen that the model Obtained by the conversion by using the linear-programming-approximation method is also a good approximation of the original problem.

$$D_4 = \left\{F_\theta \,\middle|\, P(\tilde{p} \in A) = 1,\ E[\tilde{p}] = \mu_0,\ \mathrm{Cov}(\tilde{p}) = \sum_0,\ \theta = a^T\tilde{p}\right\} \tag{41}$$

$$\Lambda = \left\{\tilde{p} \in R^d \,\middle|\, (\tilde{p} - \mu_0)^T \sum_0^{-1} (\tilde{p} - \mu_0) \le d + \frac{\delta^2}{\lambda_{min}}\right\} \tag{42}$$

$$\delta = \max\{\|\overline{p} - \mu_0\|,\ \|\mu_0 - \underline{p}\|\} \tag{43}$$

Step S3: by using a solved result of the distributed robust chance-constraint model as an evaluation criterion, by using a tabu-search algorithm, determining a furnace-batch sequence and a distribution theme in the steelmaking-and-continuous-casting dispatching.

Figure 3:
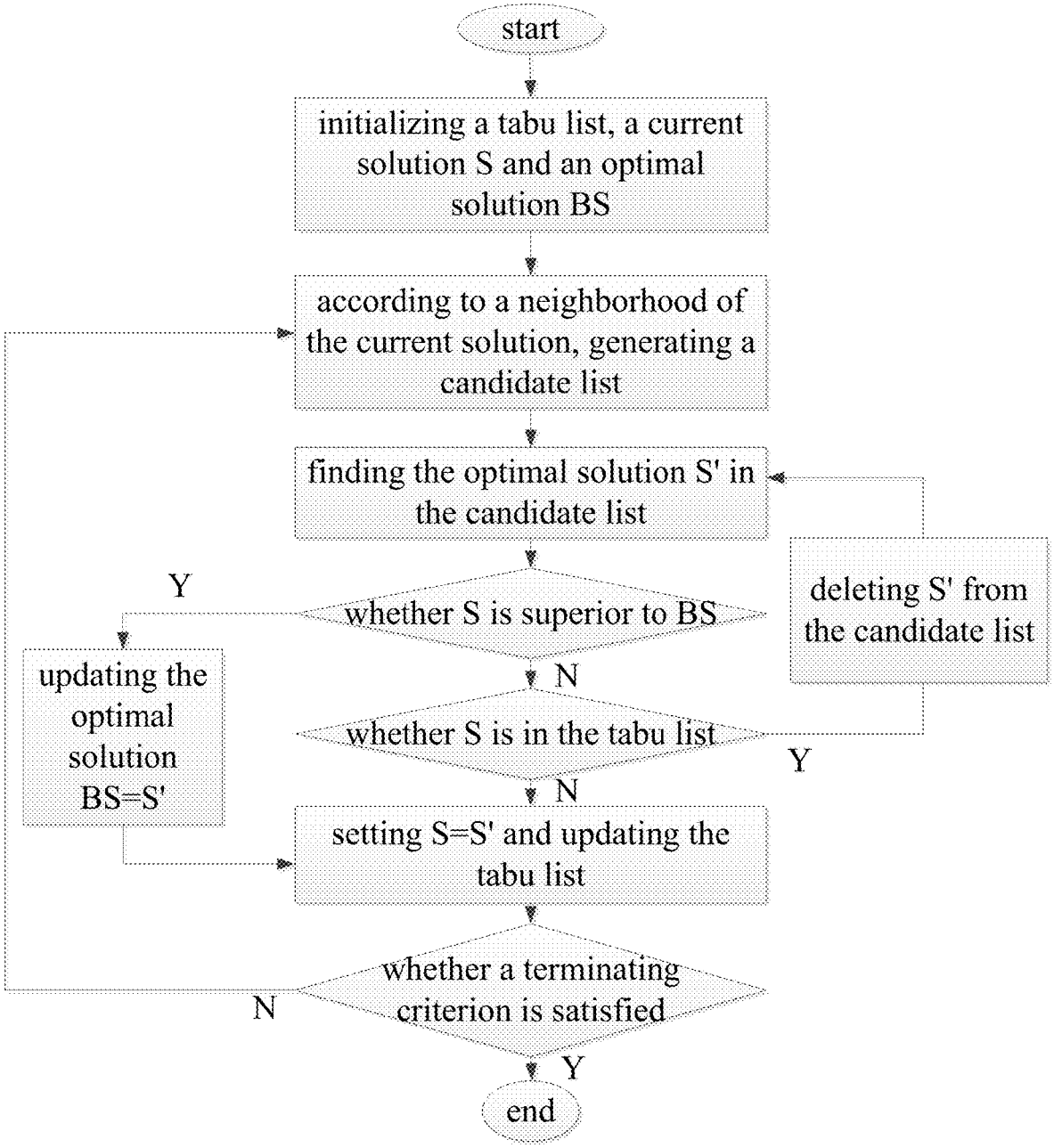
FIG. 3 is a flow chart of the tabu-search algorithm according to an embodiment of the present disclosure.

As shown in FIG. 3, the tabu-search algorithm comprises:

S31: initializing a tabu list, a current solution and an optimal solution;

S32: according to a neighborhood of the current solution, generating a candidate list;

S33: selecting an optimal solution in the candidate list;

S34: by using a value of the objective function obtained by solving the distributed robust chance-constraint model as an evaluation index, determining whether the current solution is superior to the optimal solution; if yes, updating the optimal solution into the optimal solution in the candidate list, and executing S35; and if no, determining whether the current solution is in the tabu list, if no, deleting the optimal solution of the candidate list from the candidate list, and executing S33, and if yes, executing S35;

S35: by using the optimal solution that has been updated as the current solution, updating the tabu list; and

S36: determining whether a terminating criterion is satisfied, if no, executing S32, and if yes, according to the current solution, determining the furnace-batch sequence and the distribution theme in the steelmaking-and-continuous-casting dispatching.

The tabu-search algorithm is a method of local searching, and has been proved to be able to simply but effectively solve the problem of flow shop and variations thereof. Its key point is to improve the solutions that have already been obtained, and it can effectively improve the current solution with limited time and resource, and prevent repeatedly obtaining the same solution in the searching process, thereby reaching a very good balance between exploration and utilization. Therefore, the tabu-search algorithm is selected to determine the furnace-batch sequence and the distribution theme.

The tabu-search algorithm starts from an initial solution, and in each time of the iteration of the algorithm, a candidate list is generated according to the neighborhood of the current solution. The solutions in the candidate list are not in the tabu list, and are not the best solution that has been found currently, wherein the optimal solution will be selected as a new solution. Such a selection is referred to as movement, and the new solution will be added into the tabu list, to prevent searching for a point that has already been selected. Such an iteration process is repeated till a termination condition is satisfied.

The steelmaking-and-continuous-casting dispatching method based on a distributed robust chance-constraint model according to the present disclosure will be described with reference to the particular embodiments.

In the present disclosure, for the problem of steelmaking-and-continuous-casting dispatching having an indefinite processing duration, the total flow duration, the waiting duration and the casting-interruption profile are selected as the performance indexes. According to the practical production situations and the requirements on simplifying the model, in the model, merely the three main stages are to be considered, namely steelmaking, refinement and continuous casting. It is assumed that all of the furnace batches follow the same processing process, namely steelmaking, refinement and continuous casting; and, because the furnace-batch sequence must be consistent with the downstream processing sequence, it is assumed that the particular machines, the sequence of the cast batches and the furnace batches on the conticasters are fixed.

1) solving the processing starting durations of the furnace batches and the cast batches by using the distributed robust chance-constraint model.

According to the practical production data, the parameters required by the model are determined. For L furnace batches that require to be dispatched, its indefinite processing duration is set to be $S=\{p^i, i=1, \ldots, L\}$, the most convenient and most commonly seen form of the support set of the distribution of the processing duration is selected, as shown in the formula (2), and it may be correspondingly designed that the upper bound and the lower bound are as shown in the formula (44), and the average value and the covariance are as shown in the formula (45).

$$\underline{p} = [\underline{p}_j], \underline{p}_j = \min_i\{p_j^i\}, \overline{p} = [\overline{p}_j], \overline{p}_j = \max_i\{p_j^i\} \tag{44}$$

$$\mu_0 = \frac{1}{L}\sum_{i=1}^{L} p_i, \sum_0 = \frac{1}{L-1}\sum_{i=1}^{L}(p_i-\mu_0)(p_i-\mu_0)^T \tag{45}$$

The distributed robust model shown in the formula (3) to the formula (9) is established, and the chance constraints of the formula (4) to the formula (9) among them are converted one by one into the form of the formula (38) by using the linear-programming-approximation method, whereby the required linear programming model of conservative approximation can be obtained.

2) Determining the furnace-batch sequence and the distribution theme by using the tabu-search algorithm According to the characteristics of the practical production process of steelmaking and continuous casting, the initial solution, the neighborhood structure, the acceleration strategy, the tabu list and the terminating criterion of the tabu-search algorithm are correspondingly designed as follows, wherein the assessment on the Obtained solutions is based on the optimum target value obtained by solving the linear programming model converted from the distributed robust chance-constraint model.

The initial solution: As different from the common problem of flow shop, in the stage of continuous casting of the steelmaking-and-continuous-casting process, the furnace-batch sequence and the distribution theme are fixed; in other words, in order to make the production process more efficient, the furnace-batch sequence of the first two stages should be generally consistent with the order of the stage of continuous casting. Therefore, the furnace batches are sorted according to the positions in the last stage, and then the machines of the other stages are correspondingly sorted. An example is provided below. Considering a steelmaking-and-continuous-casting process, the first stage of it has 4 machines, the last two stages have 3 machines individually, and 10 furnace batches are to be treated. Without loss of generality, it is assumed that the serial numbers of the furnace batches processed by the conticasters are {1,2,3}, {4,5,6,7} and {8,9,10}, and they are combined according to the relative positions, to obtain the sequence {1,4,8,2,5,9,3,6,10,7}. In the other stages, they are arranged sequentially onto different machines, and, for a stage having 4 machines, the distribution themes {1,5,10}, {4,9,7}, {8,3} and {2,6} can be obtained.

The neighborhood structure: Regarding the common problem of flow shop, generally, in the first stage, an arrangement of n workpieces, rather than a complete timetable, is employed as the solution, to reduce the search space, and then the complete dispatching theme is constructed by using a priority scheduling rule or another method. However, that is not suitable for the problem of steelmaking-and-continuous-casting dispatching, because the processing durations of the furnace batches are indefinite, and the furnace-batch sequence is required to substantially correspond to the sequence in the last stage. Therefore, two arrangements of n furnace batches are employed to represent individually the orders of the furnace batches in the two stages, and it is considered whether to reinsert and exchange the two types of neighborhood in each iteration of the algorithm.

The acceleration strategy: In each time of the iteration, the searching of the neighborhood is merely performed in one stage according to one neighborhood structure. It should be noted that, for a stage having m machines and n furnace batches, the sizes of the neighborhoods reinserted and exchanged are individually n(n+m−1) and n(n−1)/2. To assess the solutions in all of the fields is very time consuming, because it is required to, for the solutions in each of the neighborhoods, solve a positive-semidefinite-programming or linear-programming problem. However, in the problem of steelmaking-and-continuous-casting dispatching, the furnace-batch sequence on the conticasters is pre-determined; in other words, in the three stages, the relative positions of the furnace batches should not be different largely. Therefore, in order to increase the searching speed, the searching process is restricted within certain promising regions. More particularly, for exchanging movement, if the position difference between two furnace batches is less than a given value $q_s$, it is considered that there is a very high probability to obtain the optimal solution, and it is accepted. For the reinserting movement, it is merely accepted if the position difference between the positions before and after the operation is less than a given value $q_r$.

The tabu list: Once a movement operation has been performed, a reverse operation is added into the tabu list, to prevent the searching process to return to the previous state. Moreover, the relative-position information is also added into the tabu list. For example, if the furnace-batch sequence is { . . . , u1, u2, u3, . . . }, and the furnace batch u2 is selected to be exchanged or inserted to another position, then [u1,u2] and [u2,u3] are added into the tabu list. In other words, the furnace batch u2, in the following several times of iteration, cannot be the immediately consecutive preceding furnace batch of the furnace batch u3, and cannot be the immediately consecutive subsequent furnace batch of the furnace batch u1. The purpose of that is to prevent repeating the same furnace batch sub-sequence in the searching process. In the designed tabu-search algorithm, the tabu length is set to be a constant value.

The terminating criterion: When the un-improved step quantity reaches the maximum value, or reaches the time limit of the algorithm, the algorithm stops.

Figure 4:
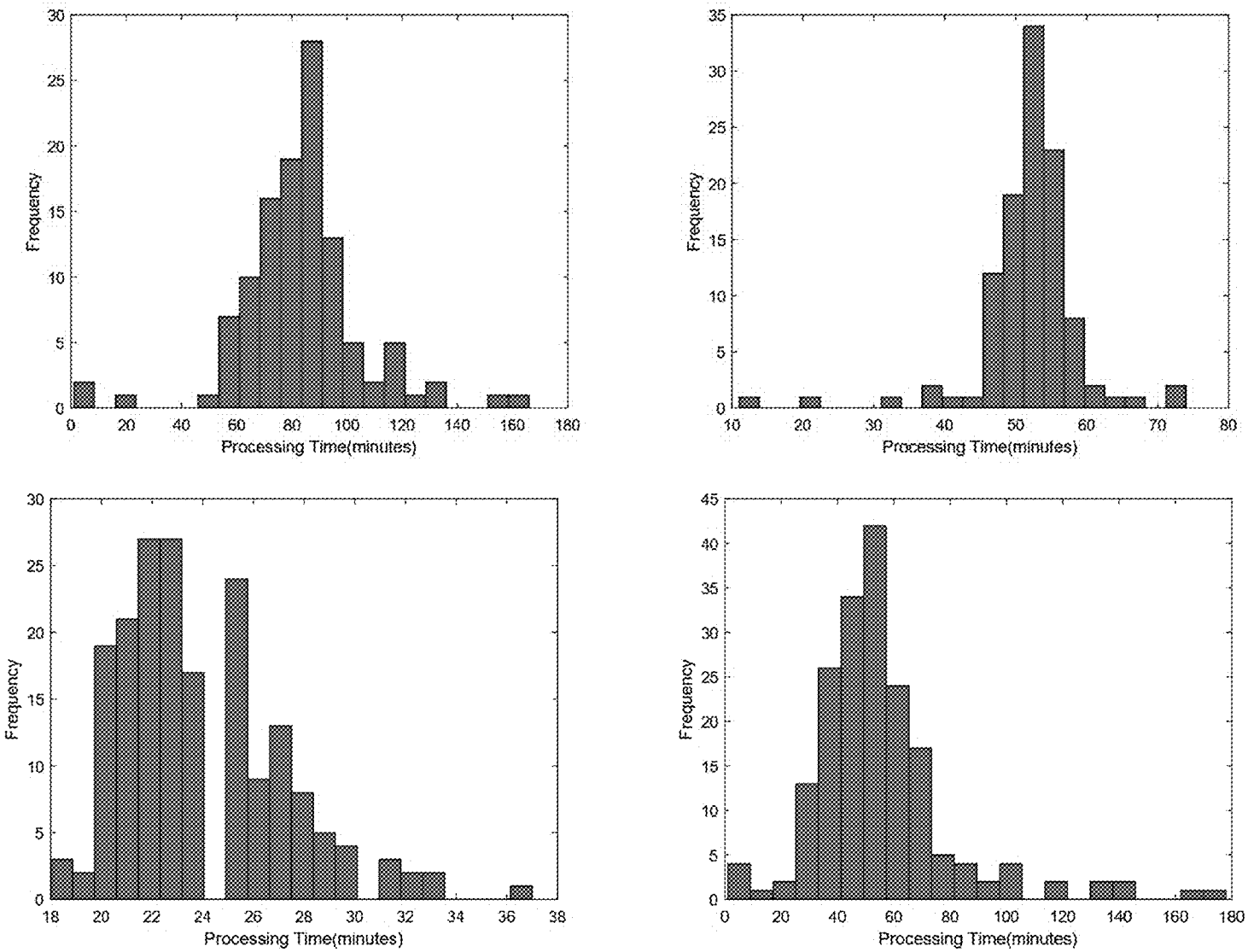
FIG. 4 is a histogram of the processing durations of different steels in different machines in the practical production data according to an embodiment of the present disclosure.

Experimentation is performed based on the practical production data of a steel company in China within two months. There are totally 2281 effective production records, and each piece of the records contains data such as the furnace batch number, the processing process, the steel grade, and the processing durations in the stages. The average value and the covariance of the processing durations are estimated according to those records. The histogram of the processing durations of different steels in different machines is shown in FIG. 4, and it can be seen that the processing duration has a large fluctuation range and different distributions. Because some special steels have little production record, and the accurate distribution of the processing durations is very difficult to obtain, the distributed robust chance-constraint model is adapted to be used to formulate the everyday production plan. The production system is formed by three converting furnaces, three refining furnaces and three conticasters. It is assumed that, in the same stage, the processing durations of the different machines to the same one furnace batch are equal, and all of the processing durations are mutually independent. The furnace-batch sequence and the distribution theme are given, the timetable of the furnace batch processing is determined, and, according to the total flow duration, the total waiting duration and the casting-interruption profile, the performances of the certainty timetable and the distributed robust chance-constraint timetable are compared. The result is shown in Table 1.

TABLE 1

Comparison between the performances of the certainty model and the distributed robust chance-constraint model under different r values

| | Set 1 (n = 36) | | | | | Set 2 (n = 38) | | | | |
|---|---|---|---|---|---|---|---|---|---|---|
| | $s^T$ | | | | | $s^T$ | | | | |
| | ε = 0.1 | ε = 0.2 | ε = 0.3 | ε = 0.4 | $s^d$ | ε = 0.1 | ε = 0.2 | ε = 0.3 | ε = 0.4 | $s^d$ |
| TFT | 32660.4 | 32170.9 | 31861.4 | 31616.1 | 29597.8 | 34474.8 | 33942.7 | 33618.0 | 33388.4 | 30404.6 |
| WT1 | 2694.7 | 2708.6 | 2711.8 | 2720.9 | 2958.2 | 3056.8 | 3061.3 | 3061.3 | 3061.3 | 3296.9 |
| WT2 | 7574.1 | 7079.2 | 6772.2 | 6551.9 | 4319.6 | 7678.6 | 7211.2 | 6911.0 | 6688.6 | 4357.6 |
| CBN | 0.50 | 0.77 | 0.98 | 1.23 | 6.03 | 0.51 | 0.79 | 1.06 | 1.32 | 6.16 |
| CBT | 10.0 | 16.5 | 22.2 | 27.6 | 163.3 | 9.8 | 17.5 | 23.8 | 30.0 | 185.4 |

Table 1 exhibits the performances of the certainty model $s^d$ and the distributed robust chance-constraint model $s^T$ in two furnace-batch sets. It can be seen that, for the practical production data, as compared with the certainty dispatching, the distributed robust chance-constraint dispatching can effectively maintain the continuity of the production process, i.e., realizing less time quantity and less duration of casting interruption. Moreover, the total flow duration of the distributed robust chance-constraint dispatching is substantially equal to that of the certainty model, the waiting duration between the stages of steelmaking and refinement is shorter, and the waiting duration between the stages of refinement and continuous casting is longer, which is equivalent to sacrificing the waiting duration between the stages of refinement and continuous casting to exchange for the continuity of the production process.

In the steelmaking-and-continuous-casting dispatching method based on a distributed robust chance-constraint model according to the embodiments of the present disclosure, firstly, the furnace-batch sequence and the distribution theme are fixed, the distributed robust chance-constraint model is proposed, and is solved by using the dual-approximation method, and the solving process is accelerated by using the linear-programming-approximation method, to obtain processing starting durations of cast batches in conticasters and processing starting durations of furnace batches in machines other than the conticasters; and subsequently the tabu-search algorithm is designed to determine the furnace-batch sequence and the distribution theme, to obtain a complete dispatching theme. The method does not decide the processing starting durations of the furnace batches in the conticasters, but merely decides the processing starting durations of the cast batches, and the method deems the processing duration in the steelmaking-and-continuous-casting process as a random variable, and makes the description by using the polyhedral support set and the accurate moment information, and the method meets the actual production conditions more than the conventional research models, and the obtained dispatching theme can be better applied to the actual production.

Secondly, the steelmaking-and-continuous-casting dispatching apparatus based on a distributed robust chance-constraint model according to the embodiments of the present disclosure will be described with reference to the drawings.

Figure 5:
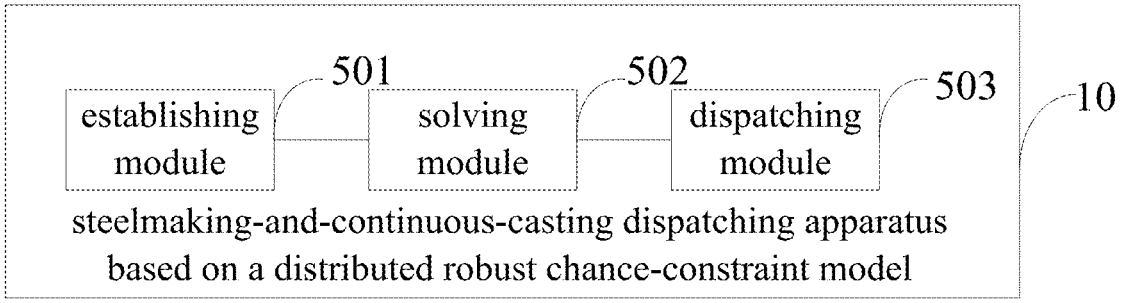
FIG. 5 is a schematic structural diagram of the steelmaking-and-continuous-casting dispatching apparatus based on a distributed robust chance-constraint model according to an embodiment of the present disclosure.

FIG. 5 is a schematic structural diagram of the steelmaking-and-continuous-casting dispatching apparatus based on a distributed robust chance-constraint model according to an embodiment of the present disclosure.

As shown in FIG. 5, the steelmaking-and-continuous-casting dispatching apparatus 10 based on a distributed robust chance-constraint model comprises an establishing module 501, a solving module 502, and a dispatching module 503.

The establishing module 501 is configured for, according to parameters, an objective function and a constraint condition in steelmaking-and-continuous-casting dispatching, establishing the distributed robust chance-constraint model.

The solving module 502 is configured for, by using a dual-approximation method or a linear-programming-approximation method, solving the distributed robust chance-constraint model, to obtain processing starting durations of cast batches in conticasters and processing starting durations of furnace batches in machines other than the conticasters.

The dispatching module 503 is configured for, by using a solved result of the distributed robust chance-constraint model as an evaluation criterion, by using a tabu-search algorithm, determining a furnace-batch sequence and a distribution theme in the steelmaking-and-continuous-casting dispatching.

Optionally, the establishing module is further configured for:

determining indefinite processing durations as a support set of random vectors $\tilde{p}$;

determining parameters and decision variables of the distributed robust chance-constraint model:

wherein the parameters of the distributed robust chance-constraint model include: N represents a set of all of the furnace batches, K represents a set of all of the cast batches, $M_i$ represents a set of machines of a processing furnace batch i including the conticasters, C represents a set of the conticasters, $C_k$ represents conticasters of a processing cast batch $\Phi_k$ represents a furnace-batch set corresponding to the cast batches k, $s^i_j$ represents a subsequent furnace batch processed in a machine j immediately following the furnace batch i, $t_{j1,j2}$ represents a transportation duration from a machine $j_1$ to a machine $j_2$, $ms^i_j$ represents a subsequent machine immediately following the processing furnace batch i of the machine j, $mp^i_j$ represents a preceding machine immediately preceding the processing furnace batch i of the machine j, $o_{ij}$ represents a sequence of the furnace-batches i in the processing cast batch in the machine j, $p_{ij}$ represents a processing duration of the furnace batch i in the machine j, st represents a starting-up duration between two cast batches, and $cs_k$ represents a subsequent cast batch immediately following a cast batch k in a same one conticaster; and the decision variables include: $sx_k$ represents a processing starting duration of a first furnace batch of the cast batch k, and $x_{ij}$ represents a processing starting duration of the furnace batch i in the machine j other than the conticasters;

determining that the objective function of the distributed robust chance-constraint model is:

$$\min c_1 \sum_{k\in K} \sum_{i\in\Phi_k} E\left(\sum_{l\in\Phi_k, o_{l,C_k}<o_{i,C_k}} \tilde{p}_{l,C_k} + sx_k - x_{i,mp^i_{C_k}} - \tilde{p}_{i,mp^i_{C_k}} - t_{mp^i_j,C_k}\right) + c_2 \sum_{i\in N} \sum_{j\in M_i, ms^i_j\notin C} E\left(x_{i,ms^i_j} - x_{ij} - \tilde{p}_{ij} - t_{j,ms^i_j}\right) + c_3 \sum_{k\in K} \sum_{i\in\Phi_k} E\left(\sum_{l\in\Phi_k, o_{l,C_k}<o_{i,C_k}} \tilde{p}_{l,C_k} + sx_k + \tilde{p}_{i,C_k}\right);$$

and determining the constraint conditions of the distributed robust chance-constraint model:

$$\inf_{F\in D_1} P\left(\sum_{l\in\Phi_k, o_{l,C_k}<o_{l,C_k}} \tilde{p}_{l,C_k} + sx_k \geq x_{i,mp^i_{C_k}} + \tilde{p}_{i,mp^i_{C_k}} + t_{mp^i_{C_k},C_K}\right) \geq 1-\varepsilon, \quad \forall k\in K, i\in\Phi_k$$

represents that, in a conticaster, when a furnace batch has completed the processing, a furnace batch to be processed next immediately should already reach the conticaster for the processing;

$sx_k \geq st$, $\forall k\in K$ represents that a starting duration of each of the cast batches is at least greater than or equal to a starting-up duration of the cast batch;

$$\inf_{F\in D_1} P\left(sx_{cs_k} \geq sx_k + \sum_{l\in\Phi_k} \tilde{p}_{l,C_k} + st\right) \geq 1-\varepsilon, \forall k\in K$$

represents that, in two immediately consecutive cast batches in a same one conticaster, a processing starting duration of the subsequent cast batch should be greater than or equal to a sum between a processing completing duration and a starting-up duration of the preceding cast batch;

$$\inf_{F\in D_1} P\left(sx_k \geq x_{i,mp^i_{C_k}} + \tilde{p}_{i,mp^i_{C_k}} + t_{mp^i_{C_k},C_k}\right) \geq 1-\varepsilon, \forall i\in\Phi_k, o_{i,C_k}=1$$

represents that a processing starting duration of any one of the cast batches is at least greater than or equal to a sum of a processing completing duration and a transportation duration of a first furnace batch in the cast batch at a preceding stage;

$$\inf_{F\in D_1} P\left(x_{s^i_j,j} - x_{ij} \geq \tilde{p}_{ij}\right) \geq 1-\varepsilon, \forall i\in N, j\in M_i/C$$

represents that, other than the conticasters, in two immediately consecutively processed furnace batches in a same one machine, merely after the preceding furnace batch has completed the processing, the subsequent furnace batch can be processed; and $$\inf_{F\in D_1} P\left(x_{i,ms^i_j} - x_{ij} \geq \tilde{p}_{ij} + t_{j,ms^i_j}\right) \geq 1-\varepsilon, \forall i\in N, ms^i_j, j\in M, ms^i_j\notin C$$

represents that, in two successive processing processes in any one of the furnace batches, merely after the preceding processing process has been completed and the furnace batch has been delivered to the subsequent machine, the subsequent processing process can be started.

Optionally, the step of, by using the dual-approximation method or the linear-programming-approximation method, solving the distributed robust chance-constraint model comprises:

by using the dual-approximation method, converting the distributed robust chance-constraint model, to convert the distributed robust chance-constraint model into a positive-semidefinite planning problem; or by using the linear-programming-approximation method, performing accelerated solving to the distributed robust chance-constraint model, to convert the distributed robust chance-constraint problem into a linear-programming problem.

Optionally, the tabu-search algorithm comprises:

initializing a tabu list, a current solution and an optimal solution;

according to a neighborhood of the current solution, generating a candidate list;

selecting an optimal solution in the candidate list;

by using a value of the objective function obtained by solving the distributed robust chance-constraint model as an evaluation index, determining whether the current solution is superior to the optimal solution; if yes, updating the optimal solution into the optimal solution in the candidate list; and by using the optimal solution that has been updated as the current solution, updating the tabu list; and if no, determining whether the current solution is in the tabu list, if no, deleting the optimal solution of the candidate list from the candidate list, and re-selecting an optimal solution in the candidate list, and if yes, by using the optimal solution that has been updated as the current solution, updating the tabu list;

by using the optimal solution that has been updated as the current solution, updating the tabu list; and determining whether a terminating criterion is satisfied, if no, newly according to a neighborhood of the current solution, generating a candidate list, and if yes, according to the current solution, determining the furnace-batch sequence and the distribution theme in the steelmaking-and-continuous-casting dispatching.

It should be noted that the above explanation and description on the embodiments of the steelmaking-and-continuous-casting dispatching method based on a distributed robust chance-constraint model also apply to the apparatus according to the present embodiment, and are not discussed here further.

In the steelmaking-and-continuous-casting dispatching apparatus based on a distributed robust chance-constraint model according to the embodiments of the present disclosure, firstly, the furnace-batch sequence and the distribution theme are fixed, the distributed robust chance-constraint model is proposed, and is solved by using the dual-approximation method, and the solving process is accelerated by using the linear-programming-approximation method, to obtain processing starting durations of cast batches in conticasters and processing starting durations of furnace batches in machines other than the conticasters; and subsequently the tabu-search algorithm is designed to determine the furnace-batch sequence and the distribution theme, to obtain a complete dispatching theme. The apparatus does not decide the processing starting duration of the furnace batches in the conticasters, but merely decides the processing starting durations of the cast batches, and the apparatus deems the processing duration in the steelmaking-and-continuous-casting process as a random variable, and makes the description by using the polyhedral support set and the accurate moment information, the apparatus meets the actual production conditions more than the conventional research models, and the obtained dispatching theme can be better applied to the actual production.

Moreover, the terms "first" and "second" are merely for the purpose of describing, and should not be construed as indicating or implying the degrees of importance or implicitly indicating the quantity of the specified technical features. Accordingly, the features defined by "first" or "second" may explicitly or implicitly comprise at least one of the features. In the description of the present disclosure, the meaning of "plurality of" is "at least two", for example, two, three and so on, unless explicitly and particularly defined otherwise.

In the description of the present disclosure, the description referring to the terms "an embodiment", "some embodiments", "example", "particular example" or "some examples" and so on means that particular features, structures, materials or characteristics described with reference to the embodiment or example are comprised in at least one of the embodiments or examples of the present disclosure. In the description, the illustrative expressions of the above terms do not necessarily relate to the same embodiment or example. Furthermore, the described particular features, structures, materials or characteristics may be combined in one or more embodiments or examples in a suitable form. Furthermore, subject to avoiding contradiction, a person skilled in the art may combine different embodiments or examples described in the description and the features of the different embodiments or examples.

Although the embodiments of the present disclosure have already been illustrated and described above, it can be understood that the above embodiments are illustrative, and should not be construed as a limitation on the present disclosure, and a person skilled in the art may make variations, modifications, substitutions and improvements to the above embodiments within the scope of the present disclosure.

What is claimed is:

1. A steelmaking-and-continuous-casting dispatching method for minimizing interruptions in casting a set of cast batches from a set of furnace batches in a steelmaking-and-continuous-casting system based on a distributed robust chance-constraint model, wherein the method comprises the steps of:

1) in the steelmaking-and-continuous-casting system, processing the set of cast batches by casting the set of cast batches into a slab in a continuous casting stage after processing the set of furnace batches comprising a liquid iron to convert the liquid iron into a liquid steel in a steelmaking stage and further processing the set of furnace batches to remove impurities from the liquid steel to produce the set of cast batches in a refinement stage, wherein the set of furnace batches and the set of cast batches are processed by a set of machines, the set of machines comprises furnaces for processing the set of furnace batches, the set of machines comprises a set of conticasters for processing the set of cast batches, the refinement stage occurs after a waiting duration between the steelmaking stage and the refinement stage, the continuous casting stage occurs after a waiting duration between the refinement stage and the continuous casting stage, and processing of the set of furnace batches in the steelmaking stage and the refinement stage and the set of cast batches in the continuous casting stage is complete after a total flow duration;

constructing the distributed robust chance-constraint model based on parameters, an objective function, and constraint conditions in steelmaking-and-continuous-casting dispatching, wherein the parameters and constraint conditions are based on production records of the steelmaking-and-continuous-casting system and the objective function considers a cost of liquid steel cooling based on a cost in the waiting duration between the steelmaking stage and the refinement stage, a cost in the waiting duration between the refinement stage and the continuous casting stage, and the total flow duration from completion of processing of the set of furnace batches in the steelmaking stage and the refinement stage and processing of the set of cast batches in the continuous casting stage;

2) solving the distributed robust chance-constraint model using a dual-approximation method or a linear-programming-approximation method to obtain processing starting durations of the set of cast batches in conticasters and processing starting durations of the set of furnace batches in the set of machines other than the conticasters; and 3) determining a furnace-batch sequence and a distribution theme in the steelmaking-and-continuous-casting dispatching based on a solved result of the distributed robust chance constraint model as an evaluation criterion and applying a tabu search algorithm;

wherein, based on the distributed robust chance-constraint model, a timetable for processing the set of cast batches is determined by controlling when the liquid steel is delivered to the set of conticasters based on the waiting duration between the steelmaking stage and the refinement stage determined under the distributed robust chance-constraint model being varied from the waiting duration between the steelmaking stage and the refinement stage determined under a certainty model and the waiting duration between the refinement stage and the continuous casting stage determined under the distributed robust chance-constraint model being varied from the waiting duration between the refinement stage and the continuous casting stage under the certainty model while the total flow duration under the distributed robust chance-constraint model is substantially equal to the total flow duration under the certainty model, wherein the waiting duration between the refinement stage and the continuous casting stage determined under the distributed robust chance-constraint model is varied from the waiting duration between the steelmaking stage and the refinement stage determined under the distributed robust chance-constraint model to lessen a duration of casting interruptions.

2. The steelmaking-and-continuous-casting dispatching method according to claim 1, wherein step 1 further comprises:

1.1) determining indefinite processing durations as a support set of random vectors $\tilde{p}$;

1.2) determining parameters and decision variables of the distributed robust chance-constraint model, Wherein the parameters of the distributed robust chance-constraint model comprise the following: N represents the set of the furnace batches, K represents the set of the cast batches, $M_i$ represents the set of machines for processing furnace batch i including the conticasters, C represents a set of the conticasters, $C_k$ represents conticasters of a processing cast batch k, $\Phi_k$ represents a furnace-batch set corresponding to the processing cast batch k, $s^i_j$ represents a subsequent furnace batch processed in a machine j immediately following the processing furnace batch i, $t_{j1,j2}$ represents a transportation duration from a machine $j_1$ to a machine $j_2$, $ms^i_j$ represents a subsequent machine immediately following the processing furnace batch i of the machine j, $mp^i_j$ represents a preceding machine immediately preceding the processing furnace batch i of the machine j, $o_{ij}$ represents a sequence of the processing furnace batch i in the processing cast batch in the machine j, $p_{ij}$ represents a processing duration of the processing furnace batch i in the machine j, st represents a starting-up duration between two cast batches, and $cs_k$ represents a subsequent cast batch immediately following the processing cast batch k in a same one conticaster; and the decision variables comprise the following: $sx_k$ represents a processing starting duration of a first furnace batch of the processing cast batch k, and $x_{ij}$ represents a processing starting duration of the processing furnace batch i in the machine j other than the conticasters;

1.3) determining that the objective function of the distributed robust chance-constraint model is:

$$\min c_1 \sum_{k\in K} \sum_{i\in\Phi_k} E\Big(\sum_{l\in\Phi_k, o_{l,C_k}<o_{i,C_k}} \tilde{p}_{l,C_k} + sx_k - x_{i,mp^i_{C_k}} - \tilde{p}_{i,mp^i_{C_k}} - t_{mp^i_j,C_k}\Big) + c_2 \sum_{i\in N} \sum_{j\in M_i, ms^i_j\notin C} E\Big(x_{i,ms^i_j} - x_{ij} - \tilde{p}_{ij} - t_{j,ms^i_j}\Big) + c_3 \sum_{k\in K} \sum_{i\in\Phi_k} E\Big(\sum_{l\in\Phi_k, o_{l,C_k}<o_{i,C_k}} \tilde{p}_{l,C_k} + sx_k + \tilde{p}_{i,C_k}\Big);$$

and 1.4) determining the constraint conditions of the distributed robust chance-constraint model as follows:

$$\inf_{F\in D_1} P\Big(\sum_{l\in\Phi_k, o_{l,C_K}<o_{l,C_k}} \tilde{p}_{l,C_k} + sx_k \geq x_{i,mp^i_{C_k}} + \tilde{p}_{i,mp^i_{C_k}} + t_{mp^i_{C_k},C_k}\Big) \geq 1-\varepsilon,\ \forall k\in K,\ i\in\Phi_k$$

represents that, in each of the conticasters, when a furnace batch has completed the processing, an immediately following furnace batch to be processed already reaches the conticaster for the processing;

$sx_k \geq st$, $\forall k\in K$ represents that a starting duration of each of the cast batches is at least greater than or equal to a starting-up duration of each of the cast batches;

$$\inf_{F\in D_1} P\Big(sx_{cs_k} \geq sx_k + \sum_{l\in\Phi_k} \tilde{p}_{l,C_k} + st\Big) \geq 1-\varepsilon,\ \forall k\in K$$

represents that, in two immediately consecutive cast batches in a same one conticaster, a processing starting duration of a subsequent cast batch is greater than or equal to a sum between a processing completing duration and a starting-up duration of a preceding cast batch;

$$\inf_{F\in D_1} P\left(sx_k \geq x_{i,mp^i_{C_k}} + \tilde{p}_{i,mp^i_{C_k}} + t_{mp^i_{C_k},C_k}\right) \geq 1-\varepsilon,\ \forall\, i\in\Phi_k,\ o_{i,C_k}=1$$

represents that a processing starting duration of any one of the cast batches is at least greater than or equal to a sum of a processing completing duration and a transportation duration of the first furnace batch in the processing cast batch at a preceding stage;

$$\inf_{F\in D_1} P\left(x_{s^i_j,j} - x_{ij} \geq \tilde{p}_{ij}\right) \geq 1-\varepsilon,\ \forall\, i\in N,\ j\in M_i/C$$

represents that, other than the conticasters, in two immediately consecutively processed furnace batches in a same one machine, after a preceding furnace batch completes the processing, a subsequent furnace batch is processed; and $$\inf_{F\in D_1} P\left(x_{i,ms^i_j} - x_{ij} \geq \tilde{p}_{ij} + t_{j,ms^i_j}\right) \geq 1-\varepsilon,\ \forall\, i\in N,\ ms^i_j,\ j\in M,\ ms^i_j\notin C$$

represents that, in two successive processing processes in any one of the furnace batches, after a preceding processing process is completed and the preceding furnace batch is delivered to a subsequent machine, a subsequent processing process is started.

3. The steelmaking-and-continuous-casting dispatching method according to claim 1, wherein step 2 comprises:

converting the distributed robust chance-constraint model into a positive-semidefinite planning problem by applying the dual-approximation method; or performing accelerated solving to the distributed robust chance-constraint model to convert the distributed robust chance-constraint problem into a linear-programming problem by applying the linear-programming-approximation method.

4. The steelmaking-and-continuous-casting dispatching method according to claim 1, wherein the tabu-search algorithm comprises:

3.1) initializing a tabu list, a current solution, and a first optimal solution;

3.2) according to a neighborhood of the current solution, generating a candidate list;

3.3) selecting a second optimal solution in the candidate list;

3.4) by using a value of the objective function obtained by solving the distributed robust chance-constraint model as an evaluation index, determining whether the current solution is superior to the first optimal solution; if yes, updating the first optimal solution into the second optimal solution in the candidate list, and executing step 3.5; and if no, determining whether the current solution is in the tabu list, if no, deleting the second optimal solution of the candidate list from the candidate list, and executing step 3.3, and if yes, executing step 3.5;

3.5) by using the second optimal solution updated as the current solution, updating the tabu list; and 3.6) determining whether a terminating criterion is satisfied, if no, executing step 3.2, and if yes, according to the current solution, determining the furnace-batch sequence and the distribution theme in the steelmaking-and-continuous-casting dispatching.

5. A steelmaking-and-continuous-casting dispatching apparatus based on a distributed robust chance-constraint model for implementing a steelmaking-and-continuous-casting dispatching method for minimizing interruptions in casting a set of cast batches from a set of furnace batches in a steelmaking-and-continuous-casting system, wherein the method comprises, in the steelmaking-and-continuous casting system, processing the set of cast batches by casting the set of cast batches into a slab in a continuous casting stage after processing the set of furnace batches comprising a liquid iron to convert the liquid iron into a liquid steel in a steelmaking stage and further processing the furnace batches to remove impurities from the liquid steel to produce the set of cast batches in a refinement stage, wherein the set of furnace batches and the set of cast batches are processed by a set of machines, the set of machines comprises furnaces for processing the set of furnace batches, the set of machines comprises a set of conticasters for processing the set of cast batches, the refinement stage occurs after a waiting duration between the steelmaking stage and the refinement stage, the continuous casting stage occurs after a waiting duration between the refinement stage and the continuous casting stage, and processing of the set of furnace batches in the steelmaking stage and the refinement stage and the set of cast batches in the continuous casting stage is complete after a total flow duration, wherein the apparatus comprises:

an establishing module configured for constructing the distributed robust chance-constraint model based on parameters, an objective function and constraint conditions in steelmaking-and-continuous-casting dispatching, wherein the parameters and constraint conditions are based on production records of the steelmaking-and-continuous-casting system and the objective function considers a cost of liquid steel cooling based on a cost in the waiting duration between the steelmaking stage and the refinement stage, a cost in the waiting duration between the refinement stage and the continuous casting stage, and the total flow duration from completion of processing of the set of furnace batches in the steelmaking stage and the refinement stage and processing of the set of cast batches in the continuous casting stage;

a solving module configured for, by using a dual-approximation method or a linear-programming-approximation method, solving the distributed robust chance-constraint model to obtain processing starting durations of cast batches in conticasters and to obtain processing starting durations of furnace batches in the set of machines other than the conticasters; and a dispatching module configured for, by using a solved result of the distributed robust chance-constraint model as an evaluation criterion, and by using a tabu-search algorithm, determining a furnace-batch sequence and a distribution theme in the steelmaking-and-continuous-casting dispatching, wherein, based on the apparatus, a timetable for processing the set of cast batches is determined by controlling when the liquid steel is delivered to the set of conticasters based on the waiting duration between the steelmaking stage and the refinement stage determined under the distributed robust chance-constraint model being varied from the waiting duration between the steelmaking stage and the refinement stage determined under a certainty model and the waiting duration between the refinement stage and the continuous casting stage determined under the distributed robust chance-constraint model being varied from the waiting duration between the refinement stage and the continuous casting stage under the certainty model while the total flow duration under the distributed robust chance-constraint model is substantially equal to the total flow duration under the certainty model, wherein the waiting duration between the refinement stage and the continuous casting stage determined under the distributed robust chance-constraint model is varied from the waiting duration between the steelmaking stage and the refinement stage determined under the distributed robust chance-constraint model to lessen a duration of casting interruptions.

6. The steelmaking-and-continuous-casting dispatching apparatus according to claim 5, wherein the establishing module is further configured for:

determining indefinite processing durations as a support set of random vectors $\tilde{p}$;

determining parameters and decision variables of the distributed robust chance-constraint model, wherein the parameters of the distributed robust chance-constraint model comprise the following: N represents a set of all of the furnace batches, K represents a set of all of the cast batches, $M_i$ represents a set of the machines for processing furnace batch i including the conticasters, C represents a set of the conticasters, $C_k$ represents conticasters of a processing cast batch k, $\Phi_k$ represents a furnace-batch set corresponding to the processing cast batch k, $s^i_j$ represents a subsequent furnace batch processed in a machine j immediately following the processing furnace batch i, $t_{j_1 j_2}$ represents a transportation duration from a machine $j_1$ to a machine $j_2$, $ms^i_j$ represents a subsequent machine immediately following the processing furnace batch i of the machine j, $mp^i_j$ represents a preceding machine immediately preceding the processing furnace batch i of the machine j, $o_{ij}$ represents a sequence of the processing furnace batch i in the processing cast batch in the machine j, $p_{ij}$ represents a processing duration of the processing furnace batch i in the machine j, st represents a starting-up duration between two cast batches, and $cs_k$ represents a subsequent cast batch immediately following the processing cast batch k in a same one conticaster; and the decision variables comprise the following: $sx_k$ represents a processing starting duration of a first furnace batch of the processing cast batch k, and $x_{ij}$ represents a processing starting duration of the processing furnace batch i in the machine j other than the conticasters;

determining that the objective function of the distributed robust chance-constraint model is:

$$\min c_1 \sum_{k\in K} \sum_{i\in\Phi_k} E\left(\sum_{l\in\Phi_k, o_{l,C_k}<o_{i,C_k}} \tilde{p}_{l,C_k} + sx_k - x_{i,mp^i_{C_k}} - \tilde{p}_{i,mp^i_{C_k}} - t_{mp^i_j,C_k}\right) +$$

-continued $$c_2 \sum_{i\in N} \sum_{j\in M_i, ms^i_j\notin C} E\left(x_{i,ms^i_j} - x_{ij} - \tilde{p}_{ij} - t_{j,ms^i_j}\right) + c_3 \sum_{k\in K} \sum_{i\in\Phi_k} E\left(\sum_{l\in\Phi_k, o_{l,C_k}<o_{i,C_k}} \tilde{p}_{l,C_k} + sx_k + \tilde{p}_{i,C_k}\right);$$

and determining the constraint conditions of the distributed robust chance-constraint model as follows:

$$\inf_{F\in D_1} P\left(\sum_{l\in\Phi_k, o_{l,C_k}<o_{i,C_k}} \tilde{p}_{l,C_k} + sx_k \geq x_{i,mp^i_{C_k}} + \tilde{p}_{i,mp^i_{C_k}} + t_{mp^i_{C_k},C_k}\right) \geq 1-\varepsilon,\ \forall k\in K,\ i\in\Phi_k$$

represents that, in each of the conticasters, when a furnace batch has completed the processing, an immediately following furnace batch to be processed already reaches the conticaster for the processing;

$sx_k \geq st$, $\forall k\in K$ represents that a starting duration of each of the cast batches is at least greater than or equal to a starting-up duration of each of the cast batches;

$$\inf_{F\in D_1} P\left(sx_{cs_k} \geq sx_k + \sum_{l\in\Phi_k} \tilde{p}_{l,C_k} + st\right) \geq 1-\varepsilon,\ \forall k\in K$$

represents that, in two immediately consecutive cast batches in a same one conticaster, a processing starting duration of a subsequent cast batch is greater than or equal to a sum between a processing completing duration and a starting-up duration of a preceding cast batch;

$$\inf_{F\in D_1} P\left(sx_k \geq x_{i,mp^i_{C_k}} + \tilde{p}_{i,mp^i_{C_k}} + t_{mp^i_{C_k},C_k}\right) \geq 1-\varepsilon,\ \forall i\in\Phi_k,\ o_{i,C_k}=1$$

represents that a processing starting duration of any one of the cast batches is at least greater than or equal to a sum of a processing completing duration and a transportation duration of the first furnace batch in the processing cast batch at a preceding stage;

$$\inf_{F\in D_1} P\left(x_{s^i_j,j} - x_{ij} \geq \tilde{p}_{ij}\right) \geq 1-\varepsilon,\ \forall i\in N,\ j\in M_i/C$$

represents that, other than the conticasters, in two immediately consecutively processed furnace batches in a same one machine, after a preceding furnace batch completes the processing, a subsequent furnace batch is processed; and $$\inf_{F\in D_1} P\left(x_{i,ms^i_j} - x_{ij} \geq \tilde{p}_{ij} + t_{j,ms^i_j}\right) \geq 1-\varepsilon,\ \forall i\in N,\ ms^i_j,\ j\in M,\ ms^i_j\notin C$$

represents that, in two successive processing processes in any one of the furnace batches, after a preceding processing process is completed and the preceding furnace batch is delivered to a subsequent machine, a subsequent processing process is started.

7. The steelmaking-and-continuous-casting dispatching apparatus according to claim 5, wherein the solving module is further configured for:

converting the distributed robust chance-constraint model into a positive-semidefinite planning problem by applying the dual-approximation method; or performing accelerated solving to the distributed robust chance-constraint model to convert the distributed robust chance-constraint problem into a linear-programming problem by applying the linear-programming-approximation method.

8. The steelmaking-and-continuous-casting dispatching apparatus according to claim 5, wherein the tabu-search algorithm comprises:

initializing a tabu list, a current solution, and a first optimal solution;

according to a neighborhood of the current solution, generating a candidate list;

selecting a second optimal solution in the candidate list;

by using a value of the objective function obtained by solving the distributed robust chance-constraint model as an evaluation index, determining whether the current solution is superior to the first optimal solution; if yes, updating the first optimal solution into the second optimal solution in the candidate list, and updating the tabu list by using the second optimal solution as the current solution; and if no, determining whether the current solution is in the tabu list, if no, deleting the second optimal solution of the candidate list from the candidate list, and re-selecting a new optimal solution in the candidate list, and if yes, updating the tabu list by using the new optimal solution as the current solution; and determining whether a terminating criterion is satisfied, if no, according to a neighborhood of the current solution, generating a new candidate list, and if yes, according to the current solution, determining the furnace-batch sequence and the distribution theme in the steelmaking-and-continuous-casting dispatching.

* * * * *